US009179714B2

(12) United States Patent
Lau

(10) Patent No.: US 9,179,714 B2
(45) Date of Patent: Nov. 10, 2015

(54) SUPPORTING WIRE FOR A BREAST COVERING GARMENT

(75) Inventor: Mun Chee Angela Lau, Hong Kong (CN)

(73) Assignee: Clover Group International Ltd, Hong Kong (HK)

( * ) Notice: Subject to any disclaimer, the term of this patent is extended or adjusted under 35 U.S.C. 154(b) by 244 days.

(21) Appl. No.: 13/382,065

(22) PCT Filed: Jun. 7, 2010

(86) PCT No.: PCT/CN2010/073602

§ 371 (c)(1),
(2), (4) Date: Jan. 3, 2012

(87) PCT Pub. No.: WO2011/003314

PCT Pub. Date: Jan. 13, 2011

(65) Prior Publication Data

US 2012/0108142 A1 May 3, 2012

(30) Foreign Application Priority Data

Jul. 8, 2009 (HK) ..... 09106159.5

(51) Int. Cl.
*A41C 1/14* (2006.01)
*A41C 3/12* (2006.01)

(52) U.S. Cl.
CPC *A41C 3/124* (2013.01); *A41C 3/122* (2013.01)

(58) Field of Classification Search
CPC ..... A41C 3/14; A41C 3/142; A41C 3/122; A41C 3/12; A41C 3/124; A41C 3/126; A41C 3/128; A41C 1/12; A41C 1/14; A41C 1/18; A41C 3/0007; A41C 3/10
USPC ..... 450/41, 45, 47–48, 51–52, 46, 49, 53; 2/262, 255, 263–264, 256–259
See application file for complete search history.

(56) References Cited

U.S. PATENT DOCUMENTS 224,413 A * 2/1880 Franz ..... 2/263
376,035 A * 1/1888 Jones ..... 2/262

(Continued)

FOREIGN PATENT DOCUMENTS

CN 1290498 4/2001
CN 2719050 Y 8/2005

(Continued)

*Primary Examiner* — Khoa Huynh
*Assistant Examiner* — Brieanna Szafran
(74) *Attorney, Agent, or Firm* — Muncy, Geissler, Olds & Lowe, P.C.

(57) ABSTRACT

A supporting wire (10) for a breast covering garment (20), comprising: a first section (8); and a second section (9) pivotally connected to the first section (8) at a distal end (11) of the first and second sections (8, 9) such that the wire (10) is movable between an expanded position and a collapsed position by pivoting the first section (8) relative to the second section (9); wherein the first and second sections (8, 9) each have a cut-out portion (14) located at the distal end (11); a first tab (16) projecting in a perpendicular direction from the first section (8) to be received in the cut-out portion (14) of the second section (9); and a second tab (16) projecting in a perpendicular direction from the second section (9) to be received in the cut-out portion (14) of the first section (8).

11 Claims, 4 Drawing Sheets

(56) References Cited

U.S. PATENT DOCUMENTS

| | | | | | |
|---|---|---|---|---|---|
| 678,713 | A * | 7/1901 | Bovy | 2/262 |
| 3,075,202 | A * | 1/1963 | Rubio | 2/132 |
| 4,064,874 | A * | 12/1977 | Valin | 602/26 |
| 4,573,455 | A * | 3/1986 | Hoy | 602/16 |
| 5,387,150 | A * | 2/1995 | Terrell | 450/41 |
| 6,206,753 | B1 | 3/2001 | Werner | |
| 6,468,130 | B1 | 10/2002 | Thakur et al. | |
| 6,761,613 | B2 | 7/2004 | Utaka | |
| 6,857,933 | B2 * | 2/2005 | Horta et al. | 450/41 |
| 2004/0053556 | A1 | 3/2004 | Horta et al. | |
| 2007/0264905 | A1 * | 11/2007 | Horta et al. | 450/41 |

FOREIGN PATENT DOCUMENTS

| | | | |
|---|---|---|---|
| CN | 1838891 | | 9/2006 |
| CN | 1838891 | A | 9/2006 |
| EP | 2 196 101 | A1 | 6/2010 |
| WO | WO 2005/002372 | | 1/2005 |
| WO | WO 2009/028381 | | 3/2009 |
| WO | WO 2009/028381 | A1 | 3/2009 |
| WO | WO 2010/074766 | | 7/2010 |

* cited by examiner

SUPPORTING WIRE FOR A BREAST COVERING GARMENT

This nonprovisional application is a national Stage of International Application No. PCT/CN2010/073602, which was filed on Jun. 7, 2010, and which claims priority to Hong Kong Patent Application No. 09106159.5, which was filed in Hong Kong on Jul. 8, 2009, and which is herein incorporated by reference.

TECHNICAL FIELD

The invention concerns a supporting wire for a breast covering garment.

BACKGROUND OF THE INVENTION

Recent studies have indicated that women's breasts have been increasing in size over the last decade. A traditional bra has an underwire which is designed to provide additional lift and give maximum shaping and support for women especially with large breasts. The underwire shapes and holds the cup of the bra to a fixed diameter. Bra manufacturers and retailers as well as women are desirous to minimize the space occupied by their bras to enable convenient transport and storage.

SUMMARY OF THE INVENTION

In a first preferred aspect, there is provided a supporting wire for a breast covering garment, comprising:

a first section; and a second section pivotally connected to the first section at a distal end of the first and second sections such that the wire is movable between an expanded position and a collapsed position by pivoting the first section relative to the second section;

wherein the first and second sections each have a cut-out portion located at the distal end;

a first tab projecting in a perpendicular direction from the first section to be received in the cut-out portion of the second section; and a second tab projecting in a perpendicular direction from the second section to be received in the cut-out portion of the first section.

The first and second sections may have an arcuate profile.

The wire may further comprise an additional section pivotally connected to the first or second section, the additional section enabling the wire to be collapsed further.

The distal ends of the first and second sections may be rounded.

When the wire is in the expanded position, the first and section sections may form a substantially smooth continuous edge.

The tab may restrict the relative movement of the first and second sections from between about 0° to 110°.

The height of the tab may be the same as the depth of the cut-out portion.

In a second preferred aspect, a bra contains a supporting wire, wherein the supporting wire is inserted in the bra at a position under a breast cup, the supporting wire comprising:

a first section; and a second section pivotally connected to the first section at a distal end of the first and second sections such that the supporting wire is movable between an expanded position and a collapsed position by pivoting the first section relative to the second section about a pivot axis;

wherein the first and second sections each have a length direction, a width direction and a thickness direction, the thickness direction being perpendicular to the length direction and the width direction and parallel to the pivot axis, wherein the first and second sections are positioned next to each other in the thickness direction, wherein the first and second sections each have a first cut-out portion located at the distal end, the first cut-out portion being cut out in the width direction, wherein the first and second sections each have a side surface formed from a second cut-out portion that extends in the length direction and is located perpendicularly to the pivot axis, wherein a first tab projects in the thickness direction outwardly from the side surface of the first section in a first direction that is parallel to the pivot axis and towards the second section to be received in the first cut-out portion of the second section;

wherein a second tab projects in the thickness direction outwardly from the side surface of the second section in a second direction that is parallel to the pivot axis and towards the first section to be received in the cut-out portion of the first section, wherein the first and second sections are delimited from pivoting beyond the expanded position as the first tab and the second tab contact the corresponding first cut-out portion of the second and first sections, respectively, wherein a shape of a region of the first section that extends from the distal end of the first section to the first tab including the first and second cut-out portions of the first section is identical to a shape of a region of the second section that extends from the distal end of the second section to the second tab including the first and second cut-out portions of the second section, and wherein the first and second sections together form a semi-circular shape to correspond to a shape and profile of the breast cup of the breast.

A height of each of the first and second tabs that projects in the thickness direction is the same as a thickness of a corresponding receiving one of the first and second sections.

When the first and second tabs are each received in and contact with the first cut-out portion of the corresponding one of the first and second sections, the first and second sections are restricted from further pivoting.

The first and second sections form a continuous semi-circular contour at the expanded position.

The first and second tab each have a rectangular plate form, and the first cut-out portion of the first and second sections corresponds to the rectangular plate form of the first and second tab to receive the first and second tab; the first and second sections each have a single tab.

Advantageously, the present invention is able to minimize the bra dimension in a quick, easy and convenient manner.

BRIEF DESCRIPTION OF THE DRAWINGS

An example of the invention will now be described with reference to the accompanying drawings, in which.

DETAILED DESCRIPTION OF THE DRAWINGS

Figure 1:
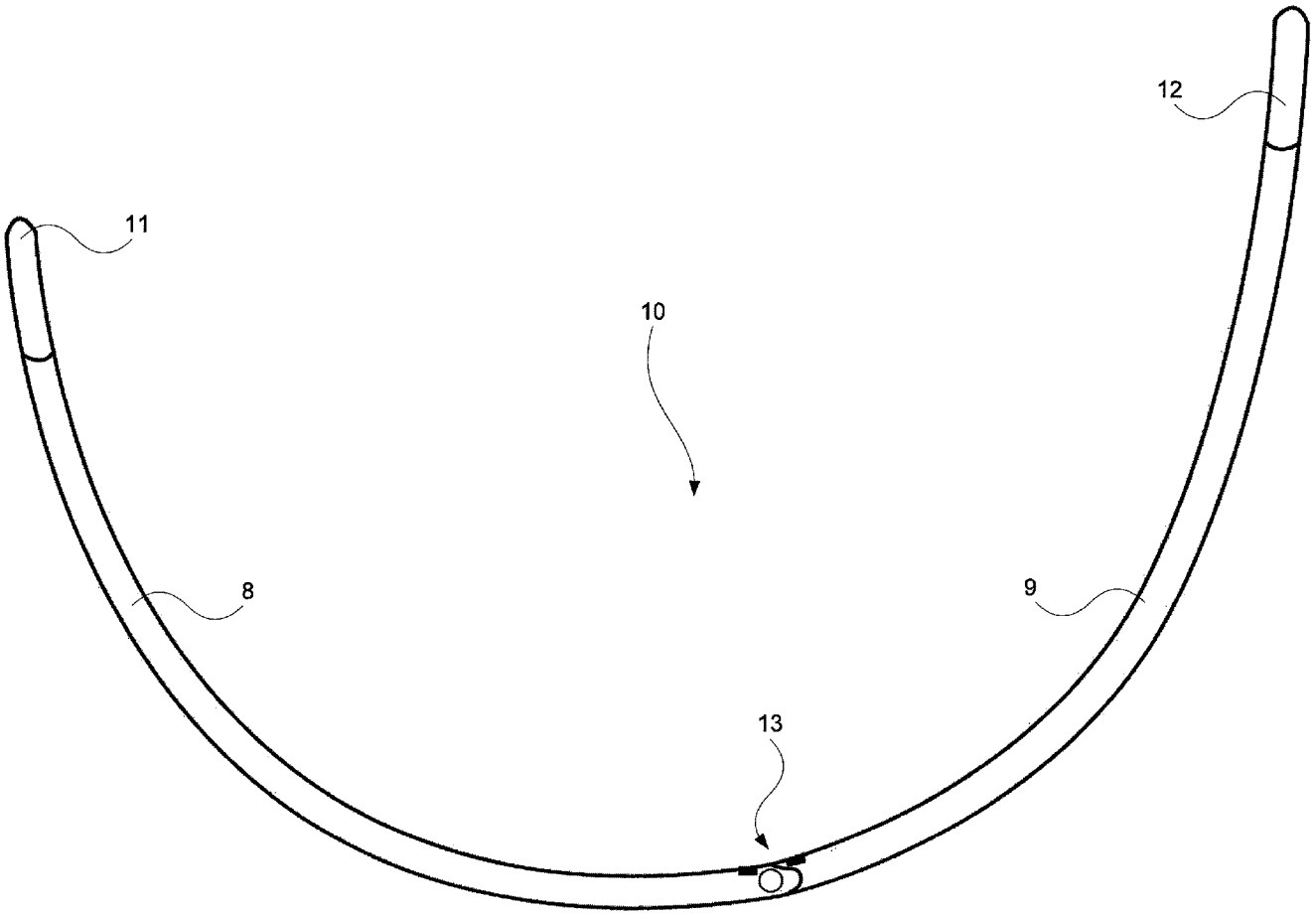
FIG. 1 is a side view of a supporting wire for a breast covering garment according to a preferred embodiment of the present invention in a fully expanded position.
Figure 2:
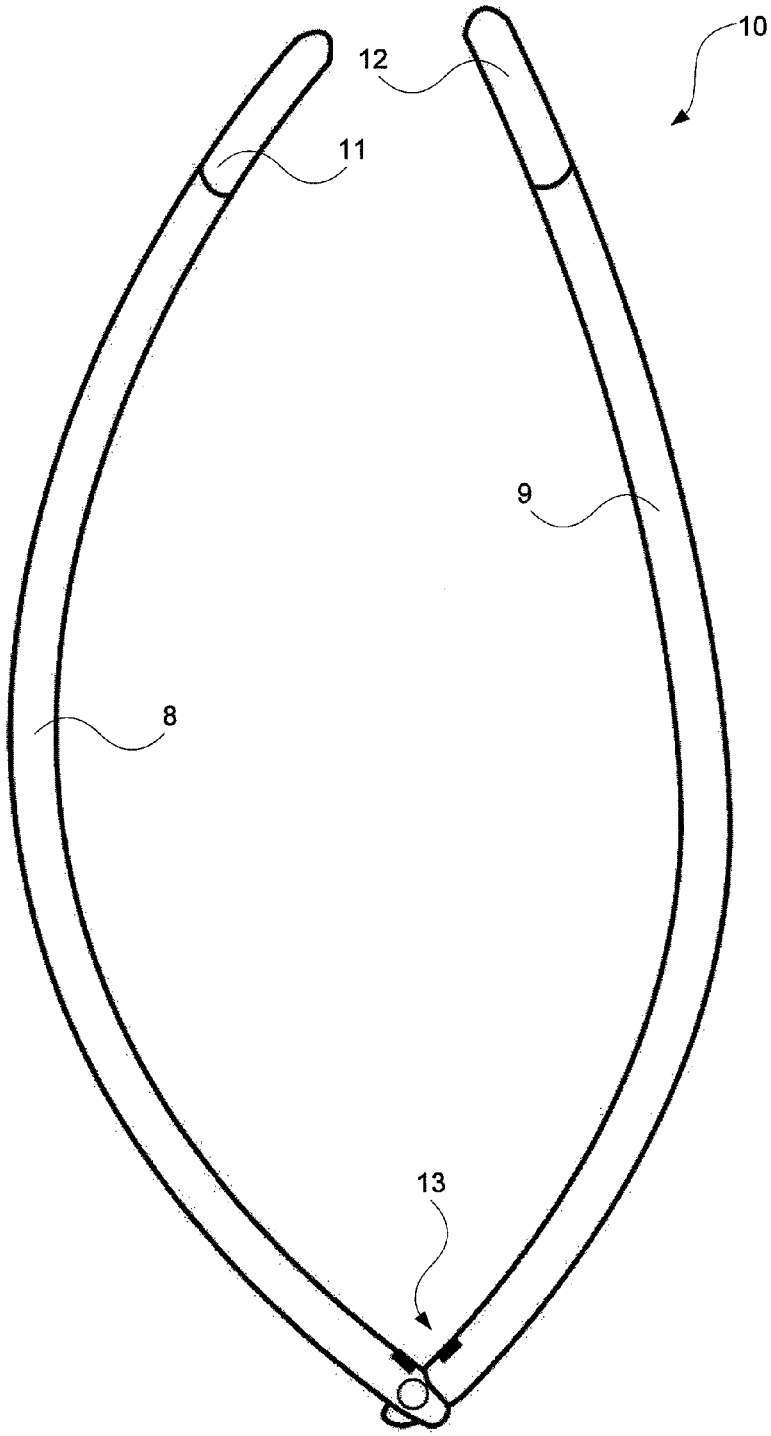
FIG. 2 is a side view of the wire of FIG. 1 in a collapsed position.
Figure 3:
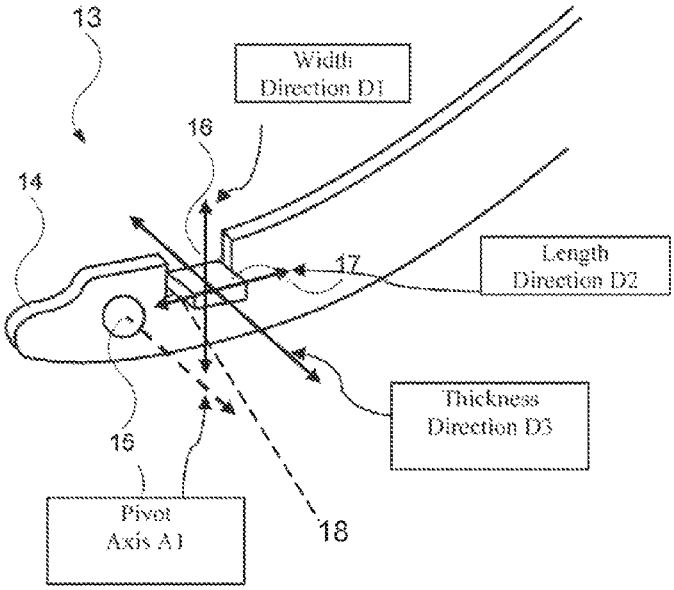
FIG. 3 is a perspective view of a pivot region of each section of the wire before the sections of the wire are pivotally connected.

Referring to FIGS. 1 and 2, a supporting wire 10 for a breast covering garment 20 is provided. The wire 10 is an arcuate underwire for a cup of a bra 20, and is preferably made from metal, or another rigid material such as plastic. Padded or non-padded bras are suitable for use with the wire 10. The distal ends 11, 12 of the wire 10 are rounded to minimize the chance for injury or damage. Each wire 10 includes two sections 8, 9. At the other end opposite to the distal ends 11, the two sections 8, 9, are pivotally connected to each other at a pivot region 13.

Referring to FIGS. 3 to 6, the pivot region 13 is described in detail. The sections 8, 9 are adjoined so that a side surface 8*a* of the section 8 and a side surface 9*a* of the section 9*a* face each other and are pivoted by a circular pivot point 15. The pivot region 13 of each of the sections 8, 9 is oriented in a width direction D1, a length direction D2 and a thickness direction D3 and pivot about a pivot axis A1. To restrict the pivoting range of motion of the sections 8, 9, a first cut-out portion 14 and a tab 17 are used. The maximum position of the pivoting range of motion should correspond to the shape and profile of the cup. Usually, the typical wire corresponds to the shape of the cup. The first cut-out portion 14 is formed at the tip of the section and has smooth edges to minimize the chance for injury or damage.

Figure 4:
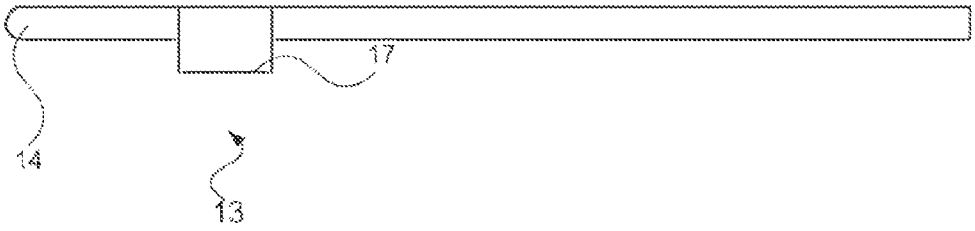
FIG. 4 is a top view of each section before the sections of the wire are pivotally connected.

The tab 17 is formed by bending over a portion of the edge of the section such that it projects outwardly from the section in a perpendicular direction. Initially, the wire 10 is from a die cut. Next, the tab 17 is formed by tooling where pressure is applied to the region of the wire 10 which causes the tab 17 to bend over from the wire 10. By bending an area of the section 8, 9, a second cut-out portion 16 in the section 8, 9 is formed. The second cut-out portion 16 has a rectangular form but this may vary depending ultimately on the shape of the tab 17. A side surface 18 is formed from the second cut-out portion 16 and extends in the length direction D2 and is located perpendicularly to the pivot axis A1. The distance that the tab 17 projects 17*a* from the section in the thickness direction D3 is about the same as the width (in thickness direction D3) of the section as depicted in FIG. 4. The tab 17 should not project 17*a* outwards too much as it may cause discomfort or increase possible damage to the fabric material of the bra 20. The position of the tab 17 on the section 8, 9 determines the minimum position of the pivoting range of motion. When the sections 8,9 are pivoted to collapse the wire 10, the tab 17 of one section 8 abuts against the edge of the other section 9, and vice versa. Preferably, the position of the tab 17 is such it enables the distal ends 11 to be adjacent to each other when the wire 10 is collapse.

Figure 5:
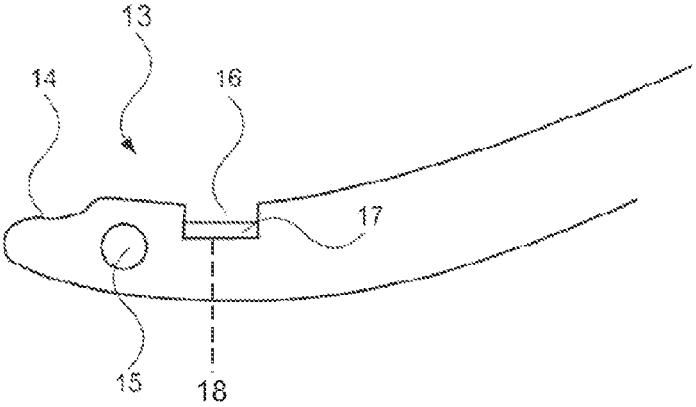
FIG. 5 is a side view of each section before the sections of the wire are pivotally connected.
Figure 6:
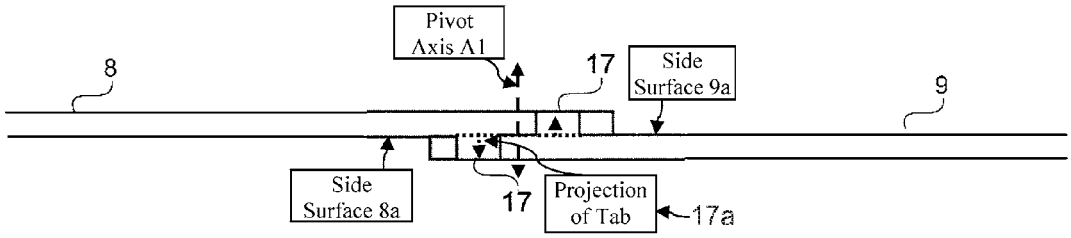
FIG. 6 is a top view of the wire of FIG. 1 in the fully expanded position.
Figure 7:
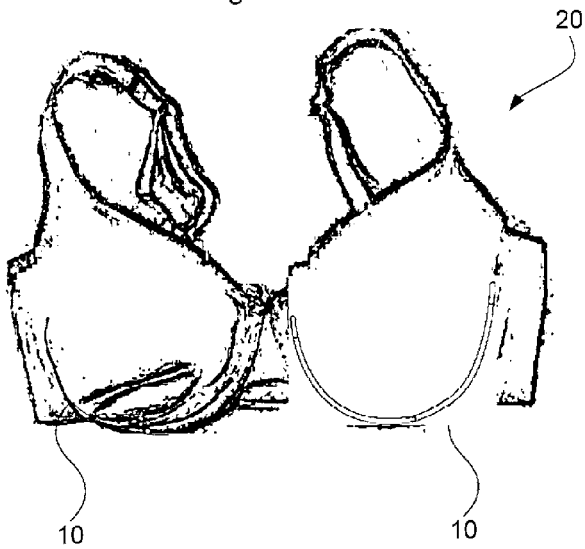
FIG. 7 is a front view of the wire in the fully expanded position when placed in the breast covering garment.
Figure 8:
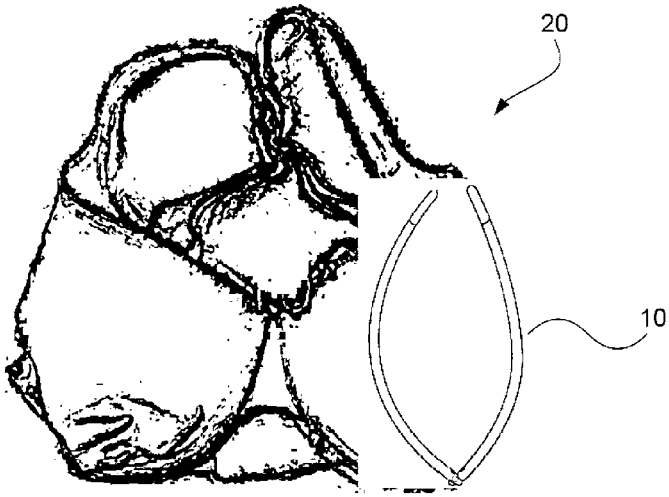
FIG. 8 is a front view of the wire in the collapsed position when placed in the breast covering garment.

The depth of the first and second cut-out portions 14, 16 are about the same as depicted in FIG. 5. This enables them to co-operate with the first and second cut-out portions 14, 16 of another section as depicted in FIG. 6. The tabs 17 are received in the first cut-out portions 14. This locks the wire 10 in the fully expanded position, and prevents it from moving beyond the predetermined pivoting range of motion.

Each cup of the bra 20 is collapsible by applying a compressive force against the tips of the wire 10. As the wire 10 collapses, the material for the bra 20 also collapses. As an example, the width of a wire 10 from tip to tip is 6" for a 40D bra at the maximum position of the pivoting range of position. After folding the wire 10 to the fully collapsed position, the width is reduced to 2.5". After collapse, the bra 20 occupies less space for storage in home closets or in luggage when travelling. This is especially advantageous for full busted or plus size women as they do not have to allocate as much space as they have previously for their bras. For retailers, occupying less space by the collapsed bras enables a greater quantity of inventory to be held at the store. Similarly, more space is provided at distribution centres. This means less transport costs are incurred since a large shipment can be used rather than requiring multiple smaller shipments. For the manufacturers of bras, the packing of bras in their collapsed state is easier and less cartons and boxes are used for the same quantity of bras that are uncollapsible. Again, transport costs are reduced and less packing material is required.

Preferably, the two sections 8, 9 are identical to reduce manufacturing costs.

It is possible that there may be more than two sections for each wire 10 resulting in more than one pivot point. This enables the wire 10 to collapse to a small profile compared with only two sections.

Although a tab 17 has been described, it is envisaged that a single raised portion on a section will suffice in order to restrict the pivoting range of motion from a fully expanded position to a fully collapsed position.

It will be appreciated by persons skilled in the art that numerous variations and/or modifications may be made to the invention as shown in the specific embodiments without departing from the scope or spirit of the invention as broadly described. The present embodiments are, therefore, to be considered in all respects illustrative and not restrictive.

I claim:

1. A bra containing a supporting wire, wherein the supporting wire is inserted in the bra at a position under a breast cup, the supporting wire comprising:

a first section; and a second section pivotally connected to the first section at a distal end of the first and second sections such that the supporting wire is movable between an expanded position and a collapsed position by pivoting the first section relative to the second section about a pivot axis;

wherein the first and second sections each have a length direction, a width direction and a thickness direction, the thickness direction being perpendicular to the length direction and the width direction and parallel to the pivot axis, wherein the first and second sections are positioned next to each other in the thickness direction, wherein the first and second sections each have a first cut-out portion located at the distal end, the first cut-out portion being cut out in the width direction, wherein the first and second sections each have a side surface formed from a second cut-out portion that extends in the length direction and is located perpendicularly to the pivot axis, wherein a first tab projects in the thickness direction outwardly from the side surface of the first section in a first direction that is parallel to the pivot axis and towards the second section to be received in the first cut-out portion of the second section;

wherein a second tab projects in the thickness direction outwardly from the side surface of the second section in a second direction that is parallel to the pivot axis and towards the first section to be received in the first cut-out portion of the first section, wherein the first and second sections are delimited from pivoting beyond the expanded position as the first tab and the second tab contact the corresponding first cut-out portion of the second and first sections, respectively, wherein a shape of a region of the first section that extends from the distal end of the first section to the first tab including the first and second cut-out portions of the first section is identical to a shape of a region of the second section that extends from the distal end of the second section to the second tab including the first and second cut-out portions of the second section, and wherein the first and second sections together form a semi-circular shape to correspond to a shape and profile of the breast cup.

2. The bra according to claim 1, wherein the first and second sections have an arcuate profile.

3. The bra according to claim 1, further comprising an additional section pivotally connected to the first or second section, the additional section enabling the supporting wire to be collapsed further.

4. The bra according to claim 1, wherein the distal ends of the first and second sections are rounded.

5. The bra according to claim 1, wherein when the supporting wire is in the expanded position, the first and section sections form a substantially smooth continuous edge.

6. The bra according to claim 1, wherein the first or second tab restricts relative movement of the first and second sections from between about 0° to 110°.

7. The bra according to claim 1, wherein a height of each of the first and second tabs that projects in the thickness direction is the same as a thickness of a corresponding receiving one of the first and second sections.

8. The bra according to claim 1, wherein when the first and second tabs are each received in and are in contact with the first cut-out portion of the corresponding one of the first and second sections, the first and second sections are restricted from further pivoting.

9. The bra according to claim 1, wherein the first and second sections form a continuous semi-circular contour at the expanded position.

10. The bra according to claim 1, wherein the first and second tab each have a rectangular plate form, and the first cut-out portion of the first and second sections corresponds to the rectangular plate form of the first and second tab to receive the first and second tab.

11. The bra according to claim 1, wherein the first and second sections each have a single tab.

* * * * *